United States Patent [19]

Baumgartner

[11] 4,341,066

[45] Jul. 27, 1982

[54] METHOD OF AND APPARATUS FOR THE BINDING OF FIBER BUNDLES

[75] Inventor: August Baumgartner, Uster, Switzerland

[73] Assignee: Zellweger Uster Ltd., Uster, Switzerland

[21] Appl. No.: 271,262

[22] Filed: Jun. 8, 1981

[30] Foreign Application Priority Data

Jul. 23, 1980 [CH] Switzerland ..... 5611/80

[51] Int. Cl.[3] ..... B65H 69/06; D01H 15/00

[52] U.S. Cl. ..... 57/22; 57/202

[58] Field of Search ..... 57/22, 261, 202

[56] References Cited

U.S. PATENT DOCUMENTS

| | | | |
|---|---|---|---|
| 3,040,153 | 6/1962 | Seney | 57/22 |
| 3,307,339 | 3/1967 | Porter | 57/22 |
| 3,504,488 | 4/1970 | Illman | 57/22 |
| 3,668,852 | 6/1972 | Fusco et al. | 57/22 |
| 4,217,749 | 8/1980 | Rohner et al. | 57/22 X |

*Primary Examiner*—Donald Watkins

*Attorney, Agent, or Firm*—Craig and Antonelli

[57] ABSTRACT

A method of and apparatus for binding fiber bundles which reduces an abrupt cross-sectional course at each end of the fiber bundle resulting from the loose ends of the bundles having been removed. The loose ends are, during the binding operation, severed in a fraying manner by abrasive edges and the frayed bound ends are worked into the resulting binding.

16 Claims, 5 Drawing Figures

METHOD OF AND APPARATUS FOR THE BINDING OF FIBER BUNDLES

FIELD OF THE INVENTION

This invention relates to a method of, and an apparatus for, binding fiber bundles. Within the context of the present invention, the term "fiber bundles" is to be understood as designating a bundle of fibers, a yarn or a ply yarn, a twine or a rope or a similar stretched structure of combined fibers or threads, in which both vegetable and animal as well as synthetic base materials or mixtures of such may be included. In the broadest sense, the invention relates in particular to the field of the textile industry, but it is not restricted to this field.

BACKGROUND OF THE INVENTION

A common problem in the manufacturing and processing industry is that of binding two or more fiber bundles together. For a long time this problem has been solved by tying or knotting the free ends of the fiber bundles which are to be bound together in a manual or mechanical manner. A binding of fiber bundles produced by tying has the disadvantage for many purposes that an abrupt cross-sectional course or discontinuity of the fiber bundle is produced in the region of the binding due to the knot which has been made. During the further processing of the tied fiber bundle, for example, in weaving or knitting, this can have a detrimental effect and may cause the threads to break or may cause other disturbances during production. Knots may also be disturbing in textile products. Thus, suggestions have repeatedly been made to accomplish the binding of fibrous material in a manner other than by tying.

Such unknotted bindings are called splices. They are produced, for example, by the individual fibers of the fiber bundles to be bound together being thoroughly whirled and mixed by means of a jet of compressed air directed on them.

When a binding of this kind has been produced, loose ends, also called tails, of the fiber bundles bound together will be found on both sides of the binding. It is therefore, usually necessary to include another working step in order to remove, i.e., in particular to cut off, the loose ends or trails as closely as possible to the binding.

Even if this work is precisely carried out, an abrupt cross-sectional course or discontinuity of the bound fiber bundle is produced in the region of the binding at the cutting point or points. This abrupt cross-sectional course and the stumps of the loose ends or trails which have been very closely severed are often disturbing in the further processing of the tied fiber bundles. For example, they may cause disturbances in operation, such as thread breaks or stoppages in weaving or knitting.

SUMMARY OF THE INVENTION

An object of this invention is to provide a method and an apparatus in which the abrupt cross-sectional course in the binding of fiber bundles is reduced.

Accordingly, the invention provides a method of binding of fiber bundles, wherein a loose end of a bundle is deflected out of its normal position and is guided away around an edge and is severed in a fraying manner by the said edge, and is then removed.

The invention also provides an apparatus for carrying out this method comprising at least two deformation members which are movably mounted on a support, the said deformation members or portions of them being movable relative to each other in an operational region, means for supplying the fiber bundles to be bound to the operational region, and means for removing bound fiber bundles from the operational region, wherein guide means are provided for deflecting at least one loose end of a bundle from the normal position of the fiber bundles and for guiding the loose end around at least one edge to sever the end in a fraying manner while the fiber bundles are being bound in the operational region between the deformation members.

BRIEF DESCRIPTION OF THE DRAWINGS

The invention will now be described with reference to the accompanying drawings, in which.

Corresponding parts are given the same reference numbers in all of the figures.

DETAILED DESCRIPTION OF THE PREFERRED EMBODIMENTS

Figure 1:
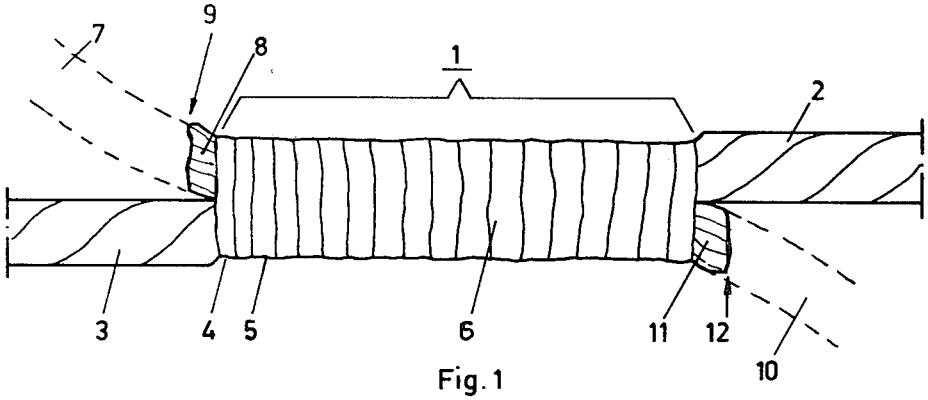
FIG. 1 illustrates a binding between two fiber bundles with a winding of the binding point with stumps of nearly flush-severed loose ends.

FIG. 1 schematically illustrates a binding 1 between two fiber bundles 2 and 3. The two fiber bundles 2 and 3 are wound and compressed in a substantially force-locking manner in the region of the binding 1 by fibers 4, 5 and 6, etc. In my copending U.S. application Ser. No. 149,545, filed May 13, 1980, there is proposed a binding for this type of fiber bundles, a method for producing the binding, and an apparatus for carrying out the method.

The above-referenced copending application describes a binding of fiber bundles which is produced by the effect of deformation members and in which fibers, originating from at least one of the fiber bundles to be bound, loop around the binding point in a force-locking manner. However, it is necessary to cut off by additional working steps the loose ends remaining on both sides of the binding after the production thereof. These loose ends may greatly hinder the further processing of the fiber bundles bound together by means of the binding mentioned, for example, in weaving or knitting.

The present invention provides a way of automatically removing the loose ends during the formation of the binding so that additional working steps mentioned are not required and an abrupt cross-sectional course is not produced. Thus, the present invention, although based on the general binding principle described in the aforesaid copending application, provides a considerable improvement thereover.

FIG. 1 illustrates a completed binding 1 produced according to the method disclosed in the aforesaid copending application, in which an original loose end 7 of a first fiber bundle 2 has already been cut off at a severing point 9 to leave a first stump 8. Likewise, an original loose end 10 of the second fiber bundle 3 has been cut off at a severing point 12 to leave a second stump 11. It may now be seen that an abrupt cross-sectional course or discontinuity is produced in the region of the severing points 9 and 12. This inconsistency in the cross section at the severing points 9 or 12, respectively, may be very disadvantageous, as mentioned, in the further processing of the fiber bundles 2 and 3 thus bound together because, for example, the smooth passage through a reed, an eye or a hook of a knitting machine is hindered thereby.

Figure 2:
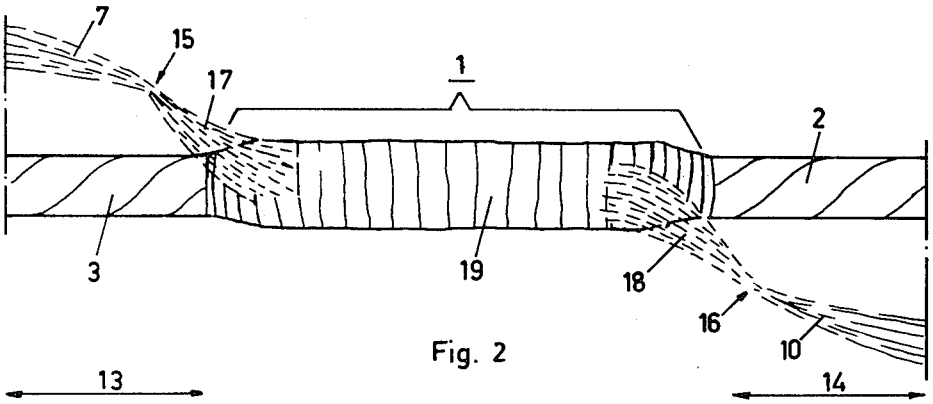
FIG. 2 illustrates an intermediate stage in the formation of a binding of two fiber bundles according to the invention.

FIG. 2 illustrates an intermediate stage in the formation of a binding 1 of two fiber bundles 2 and 3 according to the present invention. In the present invention, the loose ends 7 and 10 are severed during the formation of the binding 1, for example, by a movable member in a fraying manner under tensile stress in the end regions 13 and 14. During this operation, the loose ends 7 and 10 are detached from the original fiber bundle 2 and 3. However, this detachment does not take place as precisely as with a cut, but the free loose ends 7 and 10 on one side of the movable member and the respectively opposite ends 17 and 18 remaining bound on the other side of the movable member fray out at the detachment points 15 and 16. During this procedure, individual fibers may also be torn out and thrown away. Therefore, the material cross section is continually reduced in the fraying section, as seen in FIG. 2.

Figure 3:
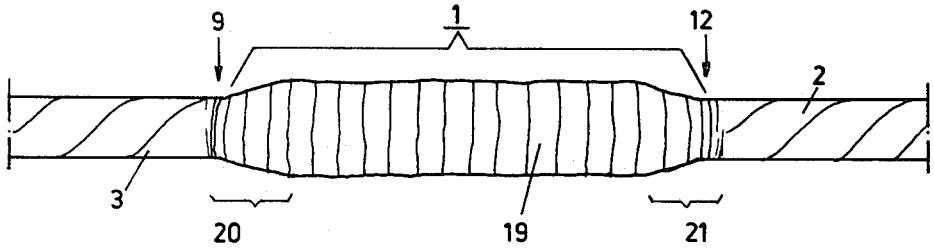
FIG. 3 illustrates a completed binding of two fiber bundles with a continuous transition of the cross-sectional course at the end regions of the binding.

While the free loose ends 7 and 10 thus severed drop or are removed by suction, for example, by a suction device, the bound ends 17 and 18 are also wound around the two bound fiber bundles 2 and 3 in a force-locking manner during a completion phase of the formation of the winding 19 of the binding 1; that is, they are worked into or are introduced into the binding 1. Finally, they each form a continuous or conical transition 20 and 21 at the ends of the binding 1 with respect to the remaining fiber bundles 2 and 3, depending on the cross-sectional ratios, as illustrated in FIG. 3.

Where there is an adequately-taut winding 19 formed by the fibers 4, 5, 6, etc., of the binding 1, the diameter of the binding 1 does not differ substantially from the diameter of the fiber bundles 2 and 3. This fact and the continuous transition 20 or 21, respectively, results in a drastic reduction in the abrupt cross-sectional course otherwise occurring at the severing points 9 and 12 (FIG. 1). As a result, a binding 1 according to FIG. 3 does not produce any difficulties in the further processing of the fiber bundles 2 and 3 bound in this manner.

The principle underlying this invention is based on the fact that the loose ends to be removed are severed in a fraying manner. This fraying severing operation may be achieved, for example, by tensile-stressing the relevant loose end, in particular, away over an edge. In this operation, the edge is preferably so designed that it exerts an abrasive effect on the fiber bundle or the loose end thereof, guided away thereover. This abrasive effect may be increased by the fact that a relative movement prevails between the loose end to be severed and the edge. At least one contour edge of at least one deformation member provided for the formation of a fiber bundle binding itself may be used, for example, as the abrasive edge. However, the fraying severing operation of a loose end may also be promoted by a member exerting a cutting effect.

Figure 4:
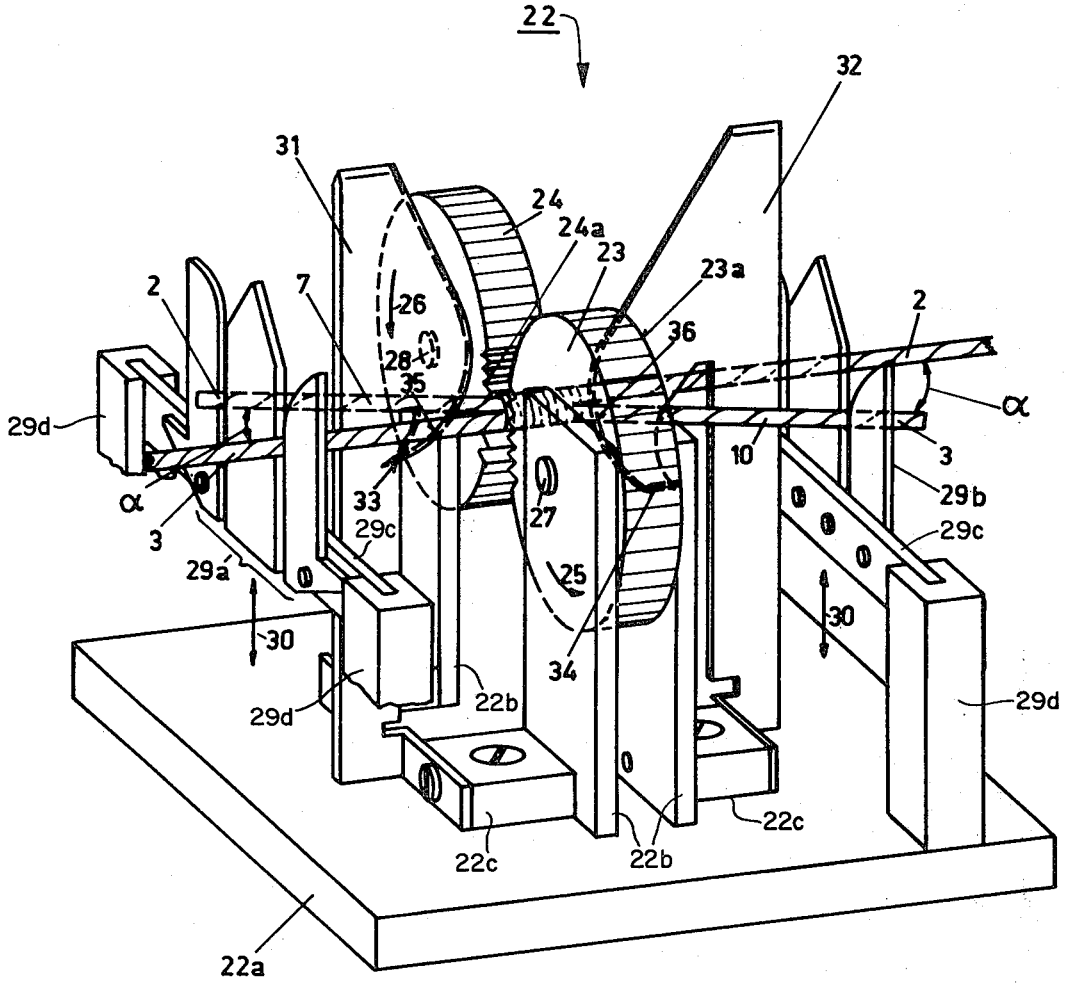
FIG. 4 is a schematic view of an apparatus for carrying out the method of the present invention.

FIG. 4 is a schematic view of an apparatus 22 for carrying out the method described with reference to FIGS. 2 and 3. The apparatus includes two deformation members 23 and 24 in the form of rotatable discs or wheels which are mounted on axles 27 and 28 for rotation in the direction indicated by arrows 25 and 26. These deformation members may take any of the forms described in my above-mentioned copending U.S. application Ser. No. 149,545. The axles 27 and 28 are mounted on support members **27*b*, which are in turn secured to a base 22*a* via support blocks 22*c*, so that the rotatable members 23 and 24** are spaced by a predetermined distance according to the size of the fiber bundles.

Guide means **29*a* and 29*b* are positioned on opposite sides of the deformation members 23 and 24 for guiding the fiber bundles 2 and 3 to be bound together into or out of the deformation members 23 and 24. The guide means 29*a*, 29*b* and the deformation members 23 and 24 are movable with respect to each other so that, for example, the guide means 29*a* and 29*b*, which are mounted on a crossbar 29*c* that is slidable in grooves in support members 29*d*, may be moved in the direction of the double-headed arrow 30 by any suitable means (not shown) or by hand. In this manner, the fiber bundles 2 and 3 which are clamped in the guides 29*a* and 29*b* with a metered force, may be brought into the operation region of the deformation members, i.e., into the narrowest region between the deformation members 23 and 24, and after the binding 1 has been produced according to FIG. 3**, they may be removed therefrom.

In the apparatus 22, the loose end 7 to be removed from the fiber bundle 2 is guided around at least one edge, for example, edge **24*a* of the one deformation member 24 and/or around an edge 35 of a severing member 31, positioned in a deflection region $\alpha$ from the normal position, i.e., the parallel direction of the fiber bundles 2 and 3 in the center region. In this arrangement, the severing member 31 may be secured to the base 22*a* via support blocks 22*c*, as seen in FIG. 4, or it may be secured on the guide means 29*a*, so as to be positioned movably therewith or relative thereto. Both due to the edge 24*a* of the moving deformation member 24 which rotates on its axle 28 during the formation of the binding 1 of the fiber bundles 2 and 3 as well as due to the relative movement of the loose end 7 to be removed at the edge 35 on a flange 33 of the severing member 31, or due to a displacement of the severing member in direction 30 and/or by vibration of the loose end 7 due to the structure of the moving deformation member 24 acting on the fiber bundle 2, the loose end 7 is frayed at the detachment point 15 (see FIG. 2), or is severed in a fraying manner. This effect takes place by the rubbing-through action under tensile stress of the fiber bundle 2 which is temporarily clamped in the guide means 29*a* and 29*b***.

This also applies for the other side of the apparatus 22, where the fiber bundles 2 and 3 are temporarily held in the guide means **29*b*. A severing member 32 positioned in the corresponding deflection region $\alpha$, has a flange 34 with an edge 36 over which the loose end 10 of the fiber bundle 3 to be removed is guided away. The loose end 10 is also guided to the rear edge 23*a* which cannot be seen in FIG. 4, of the deformation member 23, due to the deflection region $\alpha$. Therefore, the loose end 10 is also analogously frayed at the detachment point 16 or is severed in a fraying manner. In principle, this fraying-severing process would alone be possible by a timewise coordinated tensile strain of the loose ends 7 or 10 on the fiber bundles 2 and 3 temporarily held between the deformation members 23 and 24. However, the edges 24*a* and 35, or 23*a* and 36, respectively, which have been mentioned also promote this detachment process. The fraying severing of the loose ends 7 and 10 is further promoted by an abrasive design of the edges mentioned, in particular, also of the edges 24***a* and 23*a* of the deformation members 23 or 24, respectively, due to the structure of the surfaces thereof, which may have a corrugated or grooved configuration, for example.

As a result of the fraying severing process of the loose ends 7 and 10, the bound ends 17 and 18 (see FIG. 2) also receive an outwardly-decreasing, cross-sectional course.

While the loose ends 7 and 10 thus severed and possibly fibers released from the bound ends 17 and 18, as seen in FIG. 2, are thrown away or removed by suction, the bound ends 17 and 18 are also at least partly wound around the two bound fiber bundles 2 and 3 in a force-locking manner during the completion phase of the formation of the winding 19 of the binding 1 and/or are at least partly introduced or worked into the binding 1, as is shown by FIG. 3 in the areas 20 and 21.

When there is an adequately-taut winding 19 of the binding 1, the diameter of the binding 1 does not differ, or does not differ substantially, from the diameter of the individual fiber bundles 2 and 3. This fact and the continuous transition 20 and 21 results in a drastic reduction of the abrupt cross-sectional course otherwise occurring at the severing points 9 and 12 (FIG. 1) without the measures mentioned. Due to this fact, a binding 1 according to FIG. 3 does not present any difficulties in the further processing of the fiber bundles 2 and 3 bound in this manner and it cannot be noticed or can scarcely be noticed after the processing of the corresponding textile material.

Figure 5:
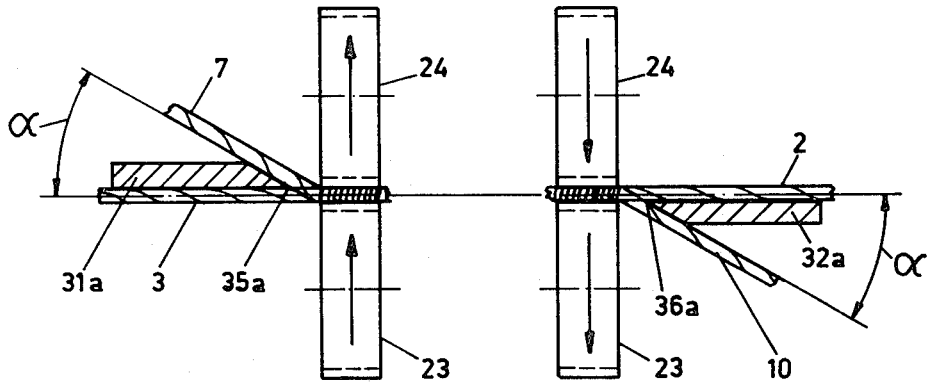
FIG. 5 is a schematic view of a part of a modification of the apparatus according to FIG. 4.

FIG. 5 is a schematic view of a part of a modification of the apparatus according to FIG. 4, in which the severing members 31*a* and 32*a* are not positioned substantially transversely to the normal portion of the fiber bundles 2 and 3, as is the case in FIG. 4, but they are positioned approximately parallel thereto in the deflection angle $\alpha$. Still, the same fraying severing action is produced which leads to the blending of the ends of the fiber bundles into the bound portion, as seen in FIG. 3.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. A method of binding of fiber bundles, comprising binding two fiber bundles together in a force-locking manner adjacent respective loose ends thereof; and during the binding of the fiber bundles, deflecting a loose end of a bundle out of its normal position, guiding that bundle away around an edge and severing the loose ends in such a manner that the loose end is intentionally frayed to a large extent by the said edge so that the remaining frayed portion on the side of the binding may be worked into the binding.

2. A method according to claim 1, wherein said severing step includes exerting an abrasive effect on the loose end by means of said edge.

3. A method according to claim 1 or 2, wherein relative movement is effected between the loose end to be severed and the said edge.

4. A method according to claim 1 or 2, wherein the binding is effected by deformation members at least one of which has an abrasive edge around which the loose end is guided.

5. A method according to claim 1 or 2, wherein a tractive force is applied on the end to be removed so that the fiber bundle belonging to that end is torn in a fraying manner.

6. A method according to claim 5, wherein the fraying operation of the end to be removed is produced by a member which has a cutting effect.

7. A method according to claim 5, wherein the fraying operation of an end to be removed takes place during the formation of the binding by means of the deformation members, a fraying end on a side of the binding being substantially worked or introduced into the resulting binding by at least one of the deformation members.

8. An apparatus for binding a plurality of fiber bundles, comprising at least two movable deformation members which are mounted on a support, the said deformation members or portions of them being profiled and movable relative to each other in an operational region formed between said members; means for moving said deformation members relative to each other in said operational region so that the profiled surfaces of said deformation members move in opposite directions in spaced relationship while engaging the fiber bundles to be bound; support means for supporting the fiber bundles to be bound in the operational region including guide means for deflecting at least one loose end of a bundle from the normal position of the fiber bundles and for guiding the loose end around at least one edge to sever the end in a manner to cause intentional fraying thereof so that the frayed end may be introduced into the resulting binding by at least one of the deformation members.

9. An apparatus according to claim 8, wherein the edge is an abrasive edge.

10. An apparatus according to claim 8 or 9, further including means for producing relative movement between the loose end to be severed and the edge.

11. An apparatus according to claim 10, wherein the edge is formed by the structure of one of the deformation members.

12. An apparatus according to claim 8, wherein the edge is an edge of a severing member, positioned in a deflection region.

13. An apparatus according to claim 12, wherein the severing member extends substantially transversely to the axial direction of the deformation members.

14. An apparatus according to claim 12, wherein the severing member extends substantially parallel to the axes of the deformation members in the deflection region.

15. An apparatus according to claim 13 or 14, wherein the severing member is secured at the guide means and is movable with the guide means.

16. An apparatus according to claim 13 or 14, wherein the severing member is movable with respect to the guide means.

* * * * *